US011369840B2

(12) United States Patent
Kazmi et al.

(10) Patent No.: US 11,369,840 B2
(45) Date of Patent: Jun. 28, 2022

(54) DYNAMIC MOUTH OPENING DEVICE

(71) Applicant: The Aga Khan University, Karachi (PK)

(72) Inventors: Syed Murtaza Raza Kazmi, Karachi (PK); Zahid Iqbal, Lahore (PK)

(73) Assignee: The Aga Khan University, Karachi (PK)

( * ) Notice: Subject to any disclaimer, the term of this patent is extended or adjusted under 35 U.S.C. 154(b) by 0 days.

(21) Appl. No.: 17/147,882

(22) Filed: Jan. 13, 2021

(65) Prior Publication Data

US 2022/0168610 A1 Jun. 2, 2022

(30) Foreign Application Priority Data

Dec. 1, 2020 (PK) ..... 804/2020

(51) Int. Cl.
*A63B 23/03* (2006.01)
*A63B 21/02* (2006.01)

(52) U.S. Cl.
CPC ..... *A63B 23/032* (2013.01); *A63B 21/023* (2013.01)

(58) Field of Classification Search
CPC ..... A63B 23/032; A63B 21/023; A61H 2205/026; A61C 7/36; A61B 1/24
See application file for complete search history.

(56) References Cited

U.S. PATENT DOCUMENTS 1,401,190 A * 12/1921 Risley ..... A61B 1/24 600/232
1,714,029 A * 5/1929 Kuhn ..... A63B 23/032 482/11
1,851,865 A * 3/1932 Ptacek ..... A63B 23/032 433/25
4,280,696 A * 7/1981 Ramon ..... A63B 23/032 482/122
5,176,594 A * 1/1993 Lee ..... A61H 1/02 482/148
5,746,703 A * 5/1998 Levatino ..... A63B 23/032 482/121
6,361,475 B1 * 3/2002 Jobe ..... A63B 21/0004 482/11
6,406,405 B1 * 6/2002 Chu ..... A63B 23/032 604/104
6,524,262 B1 * 2/2003 Akihiro ..... A63B 23/032 482/11

(Continued)

*Primary Examiner* — Jennifer Robertson
(74) *Attorney, Agent, or Firm* — Fish & Richardson P.C.

(57) ABSTRACT

A device is described that can effectively increase the range of motion of a jaw of a patient to address physiological conditions that involve restricted range of motion of the jaw of the patient. The device can be used to apply opposing forces to the maxillary and mandibular teeth, which can stretch the temporomandibular joint and mandibular muscles, which in turn can aid in opening of the jaw. Furthermore, the device includes a spring, which is configured to be stretched when the patient performs mastication motions. Such stretching of the spring dynamically applies varying amounts of force on the jaw depending on the position of the jaw during the entire range of motion of the jaw, and severity of the physiological condition such as trismus. Such dynamic force requires the jaw to perform different amounts of work at various positions, which aids in the opening of the jaw.

20 Claims, 6 Drawing Sheets

(56) References Cited

U.S. PATENT DOCUMENTS

| | | | | |
|---|---|---|---|---|
| 9,656,114 | B1 * | 5/2017 | Hafeez-Bey | A63B 21/00069 |
| 9,867,753 | B2 * | 1/2018 | Garay-Arauz | A61H 1/02 |
| 2003/0088158 | A1 * | 5/2003 | Chien | A63B 23/032 600/237 |
| 2004/0166993 | A1 * | 8/2004 | Tiberio | A63B 23/032 482/124 |
| 2007/0037665 | A1 * | 2/2007 | Robbins | A63B 21/0004 482/11 |
| 2007/0089752 | A1 * | 4/2007 | Christensen, III | A63B 23/032 128/845 |
| 2007/0287598 | A1 * | 12/2007 | Christensen, III | A61H 1/02 482/11 |
| 2012/0208677 | A1 * | 8/2012 | Lally | A63B 23/032 482/11 |
| 2014/0113771 | A1 * | 4/2014 | Kubik | A63B 23/032 482/11 |
| 2015/0251051 | A1 * | 9/2015 | Mohammed | A63B 23/032 482/11 |
| 2015/0314163 | A1 * | 11/2015 | Yoshitake | A63B 23/032 601/38 |
| 2017/0239516 | A1 * | 8/2017 | Lee | A63B 23/032 |
| 2021/0378498 | A1 * | 12/2021 | Kazmi | A61H 1/00 |

* cited by examiner

DYNAMIC MOUTH OPENING DEVICE

RELATED APPLICATION

This disclosure claims priority to Pakistan Patent Application No. 804/2020, entitled "Dynamic Mouth Opening Device" and filed on Dec. 1, 2020, the entire contents of which is incorporated herein by reference.

FIELD

This disclosure generally relates to medical treatment devices, and more specifically to mouth opening devices for the treatment of limited mandibular range of motion.

BACKGROUND

Several oral dysfunctions can restrict the range of motion of the jaw. For example, spasm of the muscles of mastication can cause trismus, also referred to as lockjaw, which is a condition permitting a limited mandibular range of motion. Trismus can interfere with various activities such as eating, speaking, and maintaining proper oral hygiene. Interference with such activities can cause further physiological complications. For example, interference with eating, and more particularly with swallowing, can result in an increased risk of pulmonary aspiration. Further, interference with speaking can result in an altered facial appearance. Moreover, besides these harmful effects, trismus can be physically painful, which can also result in physical and/or mental distress.

Regaining mandibular range of motion in a patient afflicted with trismus can be challenging. A physician can prescribe medications to reduce painful swelling of the temporomandibular joint or mandibular muscles and focusing on soft food that avoids stressing the jaw. However, such treatment is often ineffective. A patient can switch to an altered soft-food diet to ameliorate the symptoms of trismus by avoiding foods that stress their jaw until the condition improves. Though often these treatments only reduce the symptoms associated with trismus rather than directly treating the cause.

SUMMARY

This disclosure describes a device that can effectively increase the range of motion of a jaw of the patient to address physiological conditions such as trismus. The device can be used to apply opposing forces to the maxillary and mandibular teeth, which can stretch the temporomandibular joint and mandibular muscles, which in turn can aid in opening of the jaw. Furthermore, the device includes a spring, which is configured to be stretched when the patient performs mastication motions. Such stretching of the spring dynamically applies varying amounts of force on the jaw depending on (a) the position of the jaw during the entire range of motion of the jaw and (b) severity of the physiological condition such as trismus. Such dynamic force requires the jaw to perform different amounts of work at various positions, which aids in the opening of the jaw. Such opening of the jaw effectively rectifies conditions such as trismus that involve restricted range of motion of the jaw.

In general, in a first aspect, the invention features a mouth opening device including: a curved body including a cross-sectional shape; a spring disposed around a portion of an outer surface of the curved body, the spring having a cross-sectional shape substantially similar to the curved body; a first arch form including: a first grip with a first opening, the first opening having a shape corresponding to the cross-sectional shape of the curved body, the first grip slidingly disposed between a first end of the spring and a first end of the curved body; a first bite fork shaped to fit a dental arch of a patient; and a first arm angled with respect to the first grip and the first bite fork and affixing the first grip to the first bite fork; a second arch form, including: a second grip with a second opening, the second opening having a shape that is substantially similar to the cross-sectional shape of the curved body, the second grip slidingly disposed between a second end of the spring and a second end of the curved body; a second bite fork shaped to fit the dental arch of the patient; and a second arm angled with respect to the second grip and the second bite fork and affixing the second grip to the second bite fork; a first blocking element affixed at a first end of the curved body; and a second blocking element affixed at a second end of the curved body opposite the first blocking element.

Embodiments may include one or more of the following features. The cross-sectional shape of the curved body can include a circular or square cross-sectional shape. The curved body can include grooves along at least a portion of a length of the curved body. The curved body further can include between two and four grooves.

In some embodiments, the spring can have a compressive spring constant of 50 Newton/centimeter (N/cm) to 150 N/cm.

The first bite fork of the first arch form, the second bite fork of the second arch form, or both, can be composed of a rigid material. The first bite fork of the first arch form, the second bite fork of the second arch form, or both, can be composed of a malleable material. The grip of one of the arch forms can be affixed to the curved body between the first end of the spring and the first blocking element. The first end of the spring can be further affixed to the grip of the first arch form. At least one of the first blocking element or the second blocking element can be lastingly affixed to the curved body. The curved body has a radius of curvature of between ten centimeters and fifteen centimeters.

In a second aspect, the invention features a method for using a mouth opening device, the method including: positioning the mouth opening device proximal to a mouth of a patient such that a curved body of the mouth opening device is oriented vertically with respect to the patient; moving one of a first arch form of the mouth opening device and a second arch form of the mouth opening device toward the other one of the first arch form and the second arch form until bite forks of the first arch form and the second arch form come in physical contact, thereby compressing a spring disposed between the first and second arch form; disposing biting surfaces that are in the physical contact into the mouth of the patient by advancing the curved body in a proximal direction toward the mouth of the patient; allowing an extension motion of the spring to contact the bite forks of the first arch form and the second arch form with the teeth of the patient; and compressing the spring via mastication motions of a jaw of the patient.

Embodiments may include one or more of the following features. The curved body can include a cross-sectional shape. The spring can be disposed around a portion of an outer surface of the curved body, wherein the spring has a cross-sectional shape substantially similar to the curved body.

The first arch form can include: a first grip with a first opening, the first opening having a shape corresponding to a cross-sectional shape of the curved body, the first grip slidingly disposed between a first end of the spring and a first end of the curved body; a first bite fork shaped to fit a dental arch of the patient; and a first arm angled with respect to the first grip and the first bite fork and affixing the first grip to the first bite fork. The second arch form can include: a second grip with a second opening, the second opening having a shape that can be substantially similar to the cross-sectional shape of the curved body, the second grip slidingly disposed between a second end of the spring and a second end of the curved body; a second bite fork shaped to fit a dental arch of the patient; and a second arm angled with respect to the second grip and the second bite fork and affixing the second grip to the second bite fork.

The mouth opening device further can include: a first blocking element affixed at a first end of the curved body; and a second blocking element affixed at a second end of the curved body opposite the first blocking element.

The device described herein has several advantages. For example, the device described herein allows an effective treatment conditions such as trismus that involve restricted range of motion of the jaw. The treatment is effective in view of the following. The device eliminates or reduces the restriction on the motion of the jaw by opening the jaw instead of, for example, merely alleviating the pain caused by the restriction by administering pain-reducing medications. Moreover, the device includes components (e.g., spring) that provide resistive force based on (a) the position of the jaw during the entire range of motion of the jaw and (b) severity of the physiological condition such as trismus. These components thus enable the device to be (a) customized based on the anatomical structure of the jaw of the patient, and (b) adapted to the severity of the condition such as trismus of each patient. Furthermore, in some implementations, the structure of the device (e.g., one or more surfaces that are used to assist the patient in biting on food) can be customized for each patient, thereby allowing a customized treatment. Additionally, the device is made of several components that can be easily disassembled and assembled back, even by a patient who may lack clinical expertise. Such simplicity in disassembly and assembly can allow the device to be (a) easily cleaned, and (b) used on multiple patients (e.g., when the device is used in a clinic on multiple patients). Other advantages will be apparent from the description, the drawings, and the claims.

BRIEF DESCRIPTION OF THE DRAWINGS

In the drawings, like symbols indicate like elements.

DETAILED DESCRIPTION

Trismus is a restriction in the rotational range of motion of a patient's jaw, frequently painful, potentially resulting in an inability of a patient to open their mouth. This can frequently be due to tonic spasms in the muscles of the jaw, though it can also broadly refer to limited mouth opening of any cause. Traditional causes of trismus are divided into factors that stem from within the temporomandibular joint (TMJ) (e.g., intra-articular), and factors that stem from outside the TMJ (e.g., extra-articular).

Normal jaw rotational range of motion for an average person is from 35 to 45 mm with a slightly greater mouth opening for males than females (e.g., 40-60 mm). The normal side-to-side movement is 8-12 mm, and normal protrusive movement is approximately 10 mm. Mild trismus can cause a restriction of the range of motion of a patient's jaw of between 20-30 mm, moderate trismus between 10-20 mm, and severe trismus as less than 10 mm.

Figure 1:
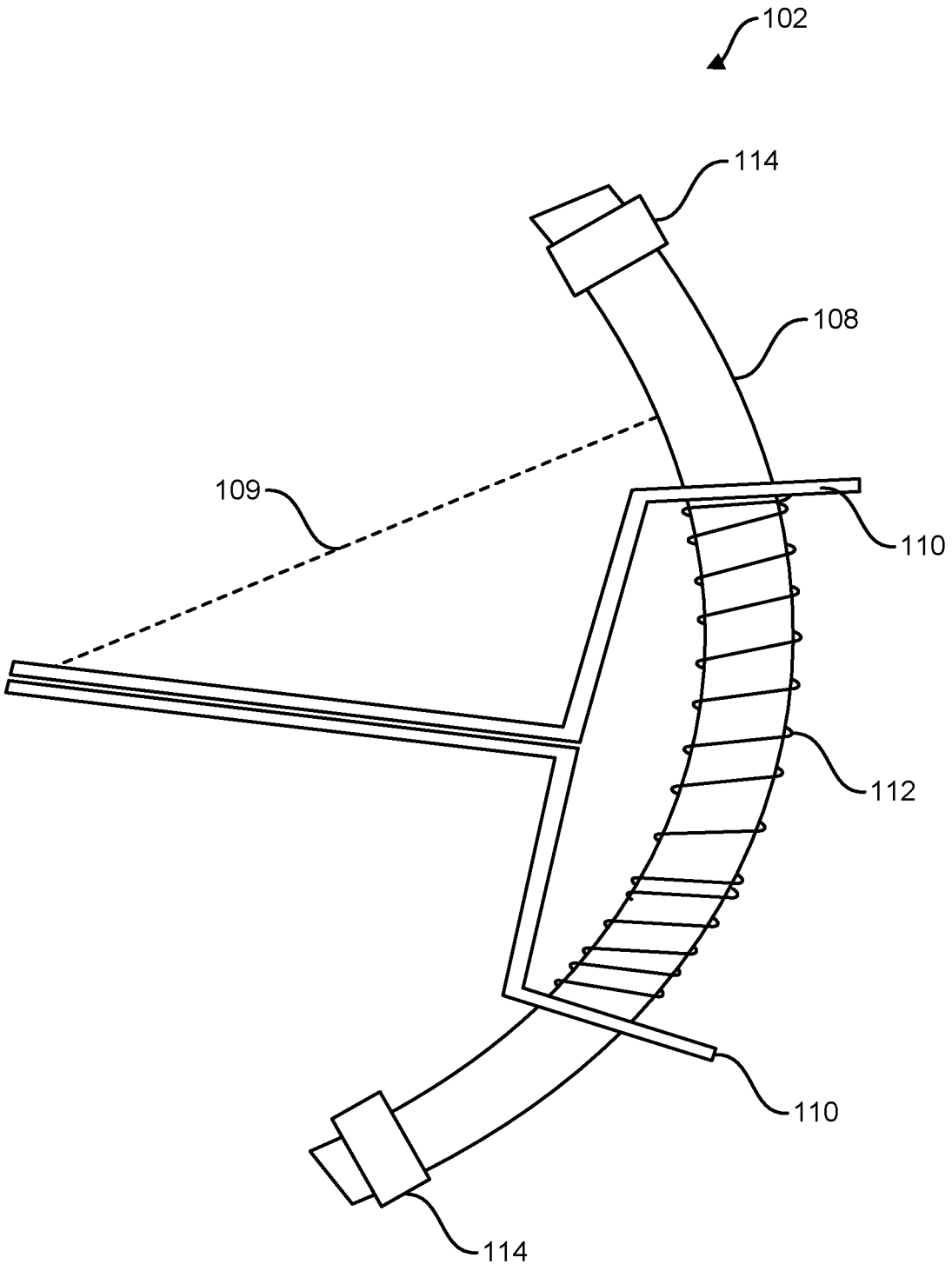
FIG. 1 illustrates a mouth opening device.

This disclosure describes an oral medical device for the treatment of limited jaw range of motion (e.g., trismus), especially relating to involuntary jaw muscle contractions. FIG. 1 illustrates a mouth opening device 102 that can help a patient to open their jaw 106 against the resistance caused the underlying trismus condition. The device 102 is composed of a curved body 108, two arch forms 110, a spring 112 disposed around the curved body 108 and between the two arch forms 110, and two blocking elements 114 installed at opposing ends of the curved body 108.

Unless otherwise noted the components of the device 102 can be constructed from materials such as metals or metallic alloys, medical-grade plastics, or ceramics. The use of materials capable of being autoclaved (e.g., stainless steel, titanium, or tungsten) can allow for the sterilization of the device between uses and patients.

The curved body 108 is arcuate and in some implementations can have a C-shape. The arc length and width of the curved body 108 is sufficient for a patient to operate the device 102 with their hands and in proximity to their face. For example, the arc length can be about 12 cm to about 30 cm (e.g., about 18 cm to about 30 cm, about 24 cm to about 30 cm, about 12 cm to about 24 cm, or about 12 cm to about 18 cm). The width can be about 1 to about 3 cm (e.g., about 2 cm to about 3 cm, or about 1 cm to about 2 cm).

The curved body 108 is composed of a metal or metallic alloy, such as stainless steel, cobalt-chrome alloy, titanium, and nickel-titanium alloy (nitinol). Other metals or alloys thereof, such as gold, platinum, silver, iridium, tantalum, and tungsten can also be considered.

In some implementations, the curved body 108 can have one or more indented grooves spaced circumferentially around the outer surface and along a portion of the length of the curved body 108. For example, there can be between 2 and 4 grooves equally spaced circumferentially around the outer surface and extending the full length of the curved body 108. The number of grooves in the outer surface of the curved body 108 can match the number of protrusions of the bite fork 110, described below.

Figure 2:
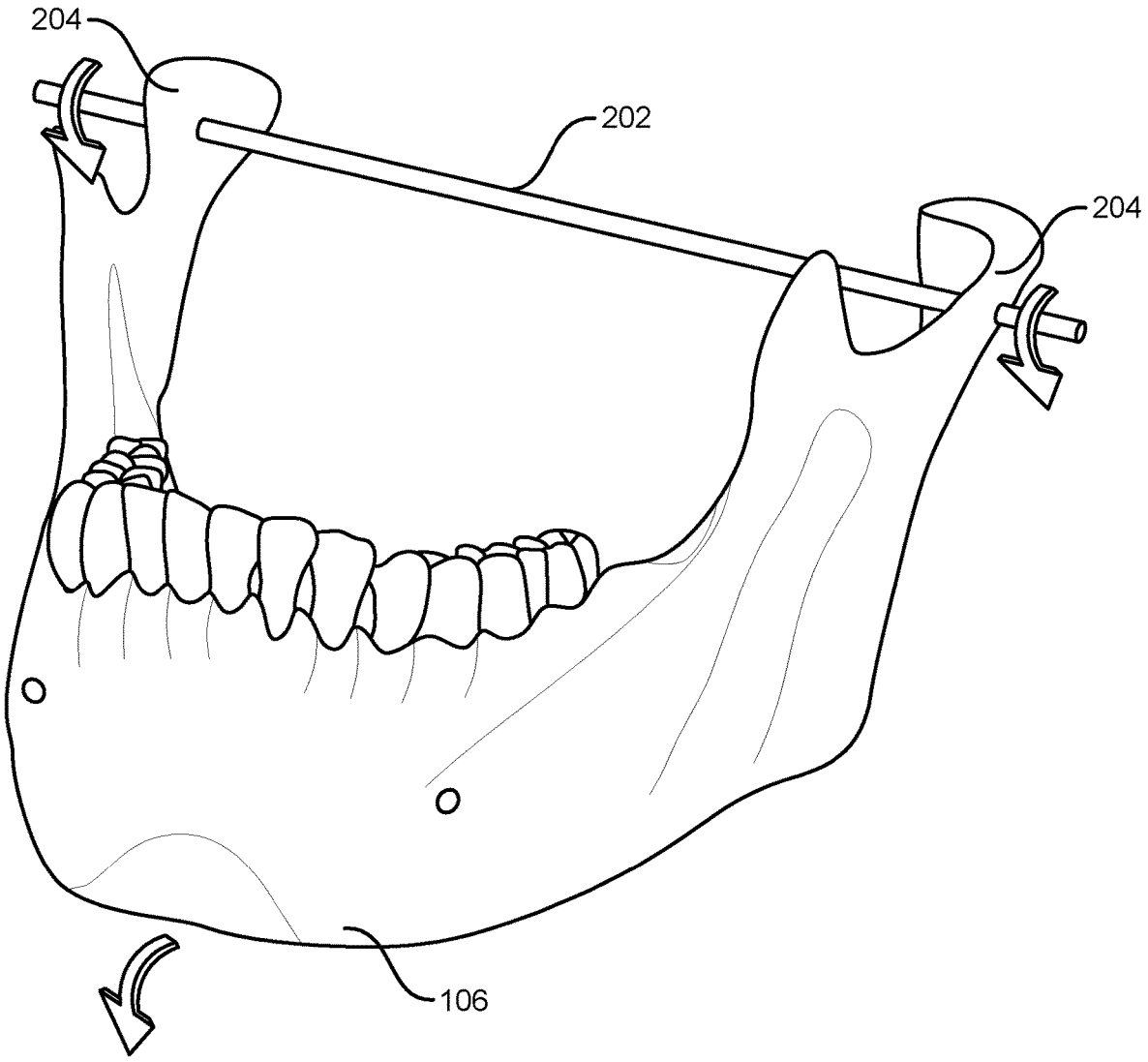
FIG. 2 illustrates a rotational axis of a jaw of the patient.

The radius of curvature 112 of the curved body 108 is long enough that the center of curvature aligns with (e.g., centers on) a patient's mandibular axis 402 of rotation, defined by a line drawn between the lateral TMJs of the patient, shown in FIG. 2.

FIG. 2 depicts an oblique frontal view of the jaw 106 (e.g., the mandible) of the patient 104, including the lower set of teeth. The lateral TMJs 204 and associated musculature (not shown) are the pivot point connecting the jaw to the skull of a patient. The patient uses the muscles of mastication (e.g., the temporalis, the masseter, and the lateral and medial pterygoid) to pivot the jaw around the TMJs 204, resulting in the teeth traveling in an upward and downward arc (e.g., a biting motion). The rotational axis of this motion is termed the mandibular axis 202 and connects the left and right TMJ 204.

Referring again to FIG. 1, the alignment of the center of curvature of the curved body 108 aids in transferring the forces of the device 102 applied to the upper (e.g., maxillary) and lower (e.g., mandibular) teeth efficiently to the TMJ and muscles of mastication. The radius 112 can be between about 10 cm to about 15 cm (e.g., about 12 cm to about 15 cm, or about 10 cm to about 13 cm). The central axis of the curved body 108 can be an arc section of a circle (e.g., constant radius of curvature), or an arc section of an ellipse (e.g., non-constant radius of curvature).

The curved body 108 can include features that resist rotation of the bite fork around the curved body 108 central axis, e.g., anti-rotational features. A square cross-sectional shape of the curved body 108 can be beneficial in preventing side-to-side rotation of the arch forms 110. This can maintain alignment of the curved body 108 with the other components of the mouth opening device during use. In other implementations, the curved body 108 may have other geometric cross sections such as elliptical, circular, or polygonal (e.g., hexagonal) cross-sections.

A spring 112 is disposed along the outer surface of the curved body 108. The cross-sectional shape of the spring 112 should conform to the cross-sectional shape of the curved body 108 to allow free movement of the spring 112 along the length of the curved body 108. The spring 112 can be composed of any material appropriate to achieve the compressive resistance necessary for the operation of the device but in general can be composed of any metal or metallic alloy disclosed herein.

A spring has a nominal length when there are no compressive or extensive forces acting upon it. The nominal length of the spring 112 should be long enough such that the uncompressed length establishes a distance between the bite forks 118 of the arch forms 100 greater than the jaw range of motion of the patient.

The force of a spring ($F_S$) is calculated as $F_s=-kx$ where k is the spring constant, a constant relating force per change in nominal length (which can be denoted in newtons per meter, or N/m), and x is the distance the spring is compressed or extended. This allows the force to dynamically vary across the entire compressive or extensive length of the spring. The spring constant k depends on the spring material, the number of winds of the spring, the dimensions of the material used, and the spring shape but an example range of spring constants for use in the mouth opening device can include about 50 N/cm to about 150 N/cm (e.g., about 100 N/m to about 150 N/m, or about 50 N/m to about 100 N/m).

The severity of a patient's trismus can also determine the spring material used in the device. Materials with higher spring constants (e.g., greater than 100 N/m) may be used in cases of severe trismus, or lower spring constants in cases of mild trismus (e.g., less than 100 N/m).

Figure 3A:
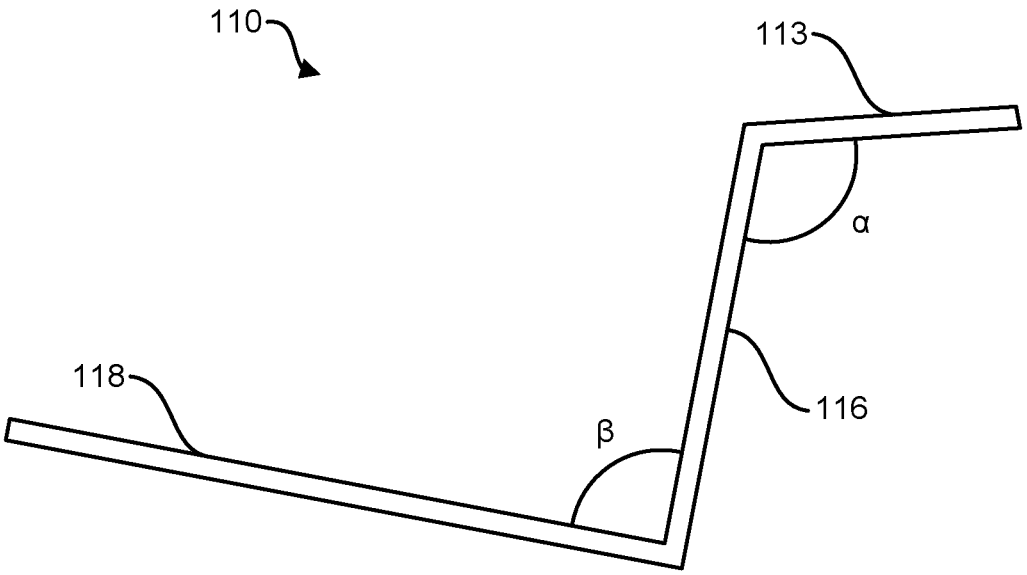
FIG. 3A illustrates a side view of the mouth opening device.

On opposing sides of the spring 112 are two arch forms 110. The arch forms 110 provide the surface which transfers the force of the spring to the upper and lower teeth of the patient. An arch form 110 is shown in greater detail in FIGS. 3A and 3B. FIG. 3A is a side view of the arch form 110 as it would be oriented in FIG. 1, relative to the mouth of a patient to the left.

The arch form 110 is an element of the device 102 composed of three sections angled respectively to each other: the grip 113, the arm 116, and the bite fork 118. The arch forms 110 are composed of a rigid material of sufficient mechanical strength to withstand the bite forces of a patient. For example, the maximum bite force of an average person is 120 N/cm$^2$. Metals disclosed herein are able to withstand these pressures and some high-density polypropylenes as well. The three components of the arch form 110 can be composed of substantially the same material by being formed together at the time of manufacture. Alternatively, the components can be composed of different materials and affixed together through material-dependent means such as welding, molding, gluing, threading, or nailing.

Figure 3B:
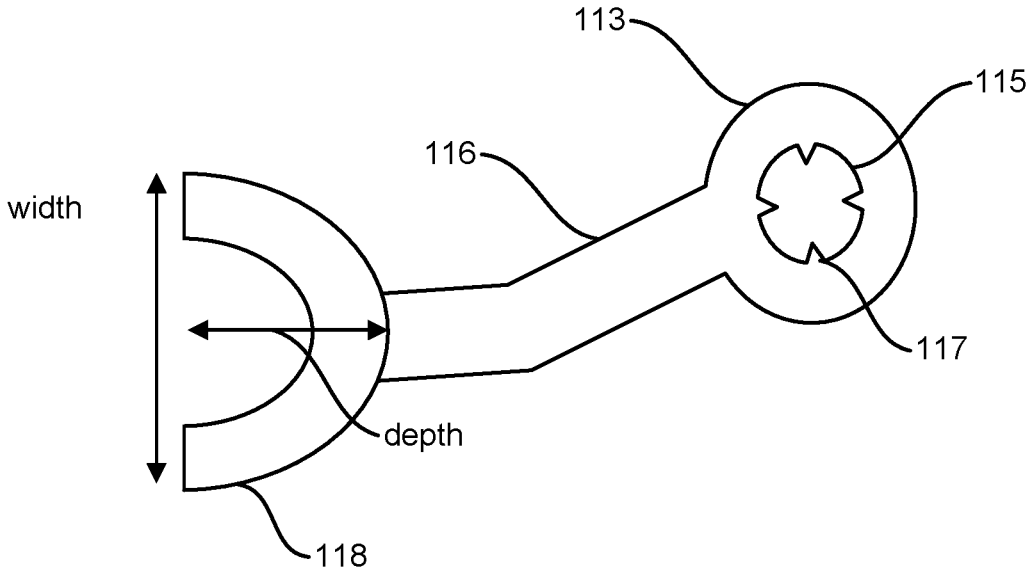
FIG. 3B illustrates a top view of the mouth opening device.

Rotating the top image of FIG. 3A toward the viewer, FIG. 3B shows an oblique top down view of the arch form 110. The grip 113 is a flat body with an inset opening 115 located centrally within the grip 113. The shape of the grip 113 and the opening 115 depicted are circular though in general, the shape of the opening 115 should conform to the cross-sectional shape of the curved body 108. The shape of the grip 113 can be any shape with a greater diameter than the opening 115 though a circular shape would conform well to the opening 115. The diameter of the opening 115 is greater than the outer diameter of the curved body 108 and smaller than the outer diameter of the spring.

In some implementations, the opening 115 can have protrusions 117, as depicted in FIG. 3B. The protrusions 117 can be small extensions from the outer circumference of the opening 115 used to contact the grooves of the curved body 108. The protrusions 117 generally have the same shape as the grooves and can be used to stabilize the radial movement of the arch form 110 during motion along the length of the curved body 108. The opening 115 has the same number of protrusions 117 as there are grooves in the curved body 108.

The arm 116 component of the arch form 110 is a length of material affixed to both the grip 113 and the bite fork 118. The arm 116 can be affixed using any material-dependent method as described above. The arm 116 transfers the forces and jaw motions between the bite fork 118 and the grip 113. The arm 116 is affixed to the grip [P141]113 at an angle, a, to orient the arm along the longitudinal axis of the curved body 108 and can be between 100° and 130° to maintain distance between the arm 116 and the curved body 108.

In general, the arm 116 can be long enough to cover the compression distance of the spring 112. The length of the arm 116 can be between about 1 cm to about 4 cm (e.g., between about 2 cm to about 4 cm, between about 1 cm to about 3 cm, between about 2 cm to about 3 cm).

The bite fork 118 of each arch form 110 is a curved planar surface shaped to conform to the curvature of a dental arch. The dental arch is a term for the shape of the plurality of teeth in the upper or lower mouth. The dental arch includes the bilateral molars, pre-molars, canines, and incisors of the patient. The shape of the bite form 118 conforms to an average dental arch and is elliptical.

The bite form 118 includes two bilateral bite arms. The width of the bite fork 118 is wide enough to provide a contactable surface for the plurality of the upper or lower teeth of a patient's mouth, or between 4 cm and 5 cm wide. The depth is sufficient for the ends of the bite fork 118 to reach the rear-most molars, or between about 5 cm to 6 cm. Each bite arm of the bite form 118 is wide enough to accommodate the row of teeth they support, or about 1 cm wide.

The bite fork 118 affixes to the arm 116 at an angle, β, sufficient to orient the plane of the bite fork 118 parallel with the plane of the patient's teeth. For example, β can be between about 80° to about 100°. The bite fork 118 can be affixed using any material-dependent method as described above. Further, the bite fork 118 extends a distance from the arm 116 sufficient to provide room for the facial features of the patient when operating the device. An exemplary range for the bite fork 118 extension can include between 1 cm and 3 cm (e.g., 2 cm to 3 cm, 1 cm to 2 cm). The ends of the bite fork 118 can be squared, as shown. In some implementations, the ends of the bite fork 118 can be rounded or hemispherical to prevent damage to the patient's oral cavity.

The bite fork 118 can be made of any material disclosed herein. The bite force of the patient is applied to the bite fork 118 and the material selected for the bite fork 118 construction should be chosen accordingly. As described above, materials capable of withstanding about 120 $N/cm^2$ without deformation can be selected for the bite fork 118, such as stainless steel, titanium or alloys thereof, or high density polypropylenes.

Alternatively, the bite fork 118 can be composed of a malleable material such as acrylic, plastic, or polymer foam that conforms to the shape of the patient's teeth. By deforming to the three dimensional profile of the teeth, material of this nature can help transfer the spring force more evenly to the upper and lower teeth, thereby reducing average pressure across any point on a single tooth.

Fitted at each end of the curved body 108 are blocking elements 114. The blocking elements 114 are components of the device 102 fitted, permanently or temporarily, to the ends of the curved body 108 to provide limits to the motion of the arch forms 110 along the length of the curved body 108.

In some implementations, the ends of the curved body 108 can be threaded to receive threading on the inner surface of the blocking elements 114 thereby connecting the blocking elements 114 to the curved body 108. The blocking elements 114 can be generally be composed of the same material as the curved body 108 including any material disclosed herein.

Figure 4:
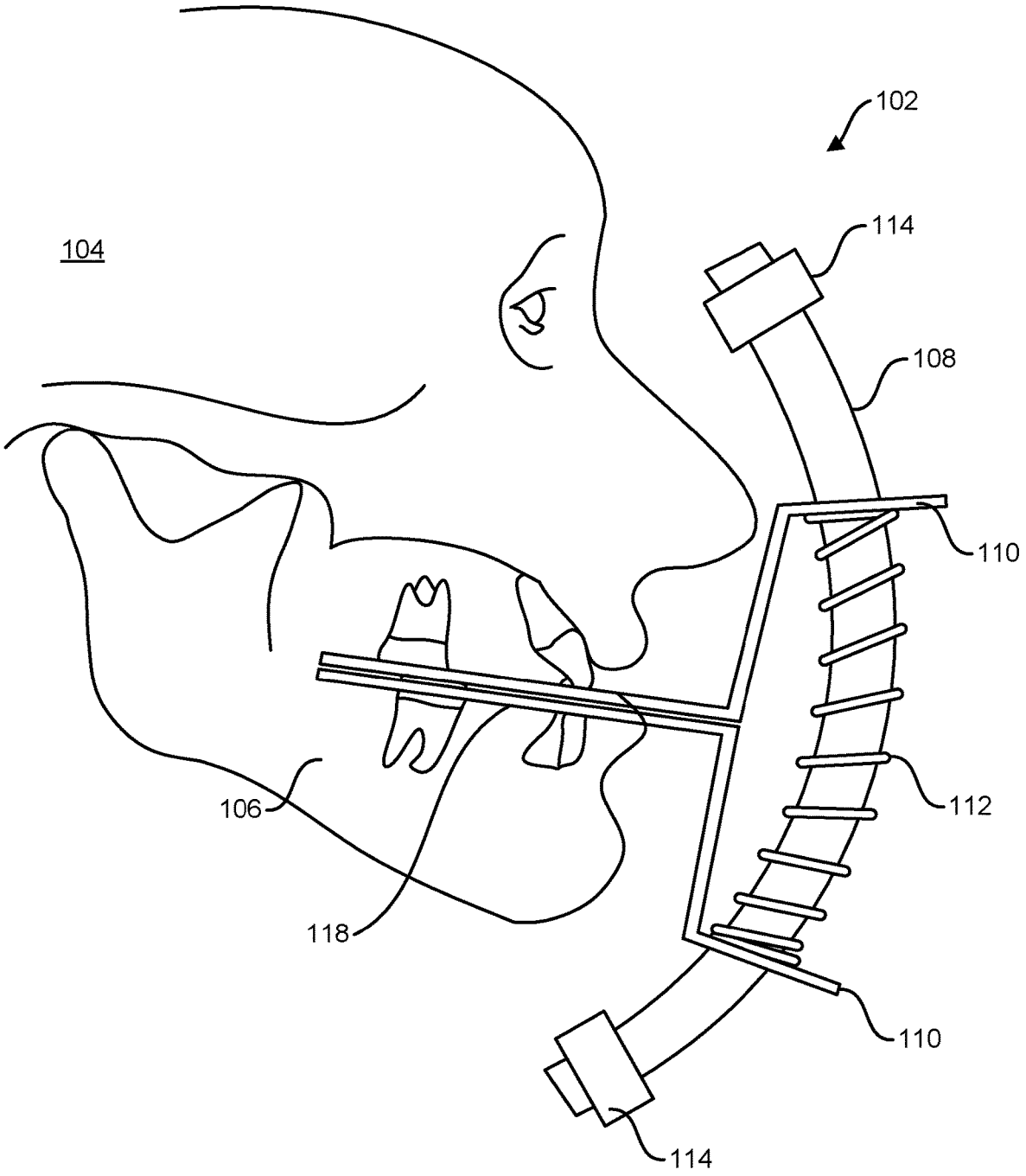
FIG. 4 illustrates the mouth opening device when positioned within a mouth of a patient.

Patients experiencing symptoms of trismus operate the mouth opening device 102 by inserting the bite forks 118 into the mouth and performing mastication motions with their jaw. In severe cases of trismus, a clinician may aid the patient in operation of the device. Referring now to FIG. 4, the patient compresses the spring 112 and arch forms 110 until the bite forks 118 contact and become parallel. The patient then inserts the bite forks 118 into the mouth and aligns the bite forks 118 with the upper and lower teeth as shown in FIG. 4. The patient 104 releases the compressive force on the arch forms 110 causing the spring to extend and moving the arch forms 110 in opposition along the length of the curved body 108.

The spring 112 extends until the bite forks 118 of the arch forms 110 are in contact with the upper and lower teeth. The spring 112 extends further and the force transfers through the arch form 110 to the upper and lower teeth thereby rotating the jaw 106 to the maximum range of motion of the patient 104. The patient 104 then closes their jaw 106 and compresses the spring 112.

Figure 5:
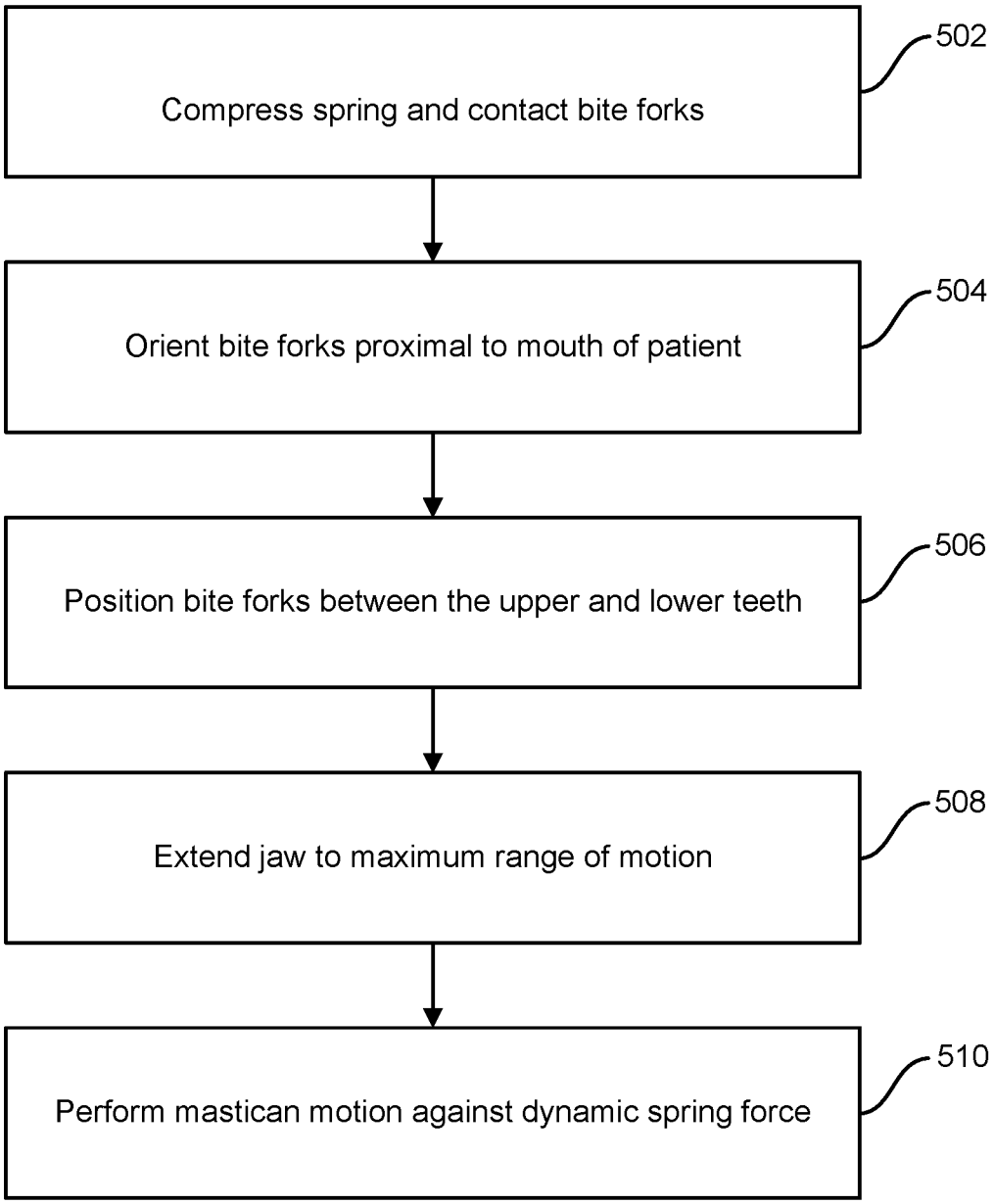
FIG. 5 illustrates a process for using the mouth opening device.

FIG. 5 is an example workflow of the method of using the mouth opening device 102. As described above, the patient moves the arch forms 110 of the mouth opening device 102 together to compress the spring 112 until the bite forks 118 are contacted and parallel (502). This allows for the trismus-constrained jaw range of motion to be as low as the width of two bite forks 118 before positioning within the mouth of the patient. This additionally stores energy in the spring 112 which is later applied to the jaw of the patient when the mouth opening device 102 is in use.

The patient brings the mouth opening device 102 into position proximal to the face of the patient with the curved body 108 oriented vertically and the arch forms 110 pointed toward the face of the patient. In this manner, the bite forks 118 are positioned nearby the mouth of the patient and oriented horizontally (504) along the same plane as the mouth. The patient opens their mouth to a width that accommodates at least the combined thickness of the two contacted bite forks 118.

The patient then disposes the contacted bite forks 118 into the mouth (506). The patient positions the bite forks 118 between the maxillary teeth of the upper mouth and the mandibular teeth of the jaw. The ends of the bite forks 118 should roughly align with the rear-most molar of the maxillary and mandibular teeth and the apex of the bite fork roughly aligns with the incisors.

The spring 112 extends to move the arch forms 110 in opposing directions along the curved body 108, thereby moving the biting surfaces of the first and second arch forms 110 into contact with the maxillary and mandibular teeth of the patient (508). The stored compressive energy extends the spring 112 and separates the arch forms 110. The force transfers through the arch forms 110 and into the jaw of the patient, which opens the mouth to the maximal rotational range of motion.

The patient closes their mouth against the resistive force of the spring 112 and compresses the spring 112 (510) until the biting surfaces contact. The patient then opens their mouth their maximal rotational range of motion once again. The spring 112 provides a dynamic resistive force during compressive and extensive motions of the patient. In this manner, the patient repeats these motions to exercise the mandibular muscles and increase the maximum rotational range of motion of their jaw.

Figure 6:
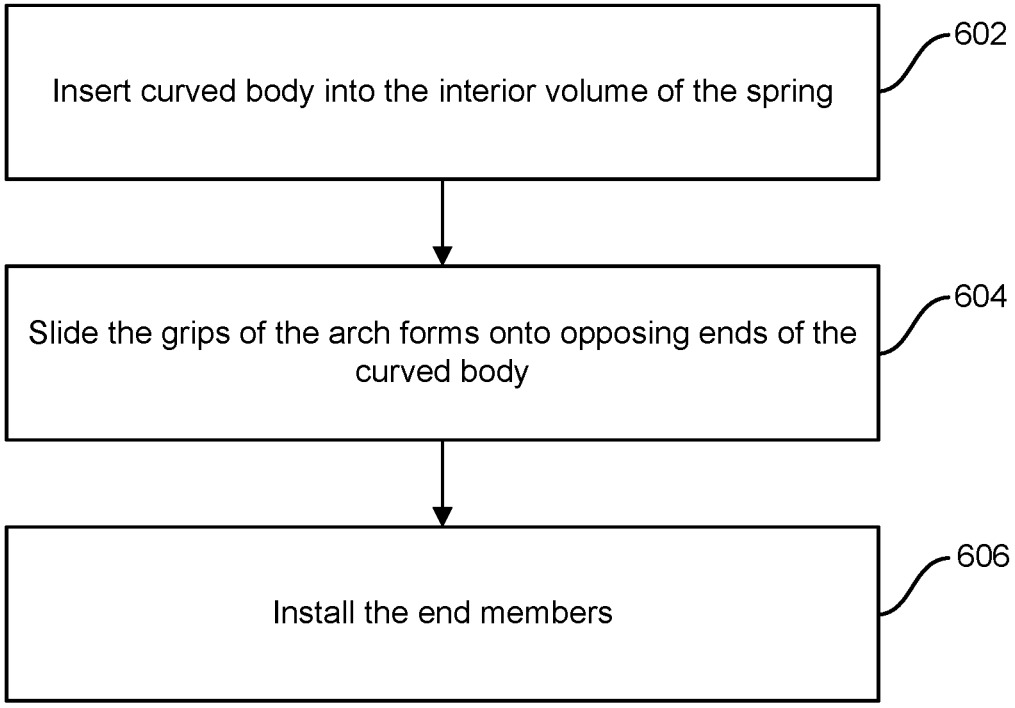
FIG. 6 illustrates a process for assembling the mouth opening device.

FIG. 6 is an example workflow of constructing the mouth opening device 102 from constituent elements. A patient inserts the curved body 108 into the interior volume of the spring 112 (602). As described above, the inner cross sectional shape of the spring 112 should approximately match the cross-sectional shape of the outer surface of the curved body 108, thereby when placing the curved body 108 into the spring 112 there should only be a minimal gap between the inner surface of the spring 112 and the outer surface of the curved body 108.

The patient then inserts one end of the curved body 108 through the grip of one arch form 110 and the opposite end of the curved body 108 through the grip of the second arch form 110 (604), and ensure that the bite forks 118 of the arch forms 110 are parallel. If the curved body 108 has grooves in the outer surface and the grip of the arch forms 110 have similar indentations, the patient should orient the indentations in alignment with the grooves before inserting the end through the grip. In this manner, the grips should constrain the spring 112 between the arch forms 110 and movement to bring the arch forms 110 into proximity should compress the spring 112.

The patient then installs the blocking elements 114 at opposing ends of the curved body 108 (606). The blocking elements 114 constrain the arch forms 110 to motion along the length of the curved body 108 without accidental removal. The blocking elements 114 can be affixed permanently or temporarily.

While a patient has been described as using the device, in some implementations any other patient may use the device such as a clinical student, a clinical practitioner, or any other patient.

While this specification contains many specifics, these should not be construed as limitations on the scope of the disclosure or of what may be claimed, but rather as descriptions of features specific to particular implementations. Certain features that are described in this specification in the context of separate implementations may also be implemented in combination in a single implementation. Conversely, various features that are described in the context of a single implementation may also be implemented in multiple implementations separately or in any suitable sub-combination. Moreover, although features may be described above as acting in certain combinations and even initially claimed as such, one or more features from a claimed combination may in some examples be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems may generally be integrated together in a single software product or packaged into multiple software products.

A number of implementations have been described. Nevertheless, it will be understood that various modifications may be made without departing from the spirit and scope of the disclosure. For example, various forms of the flows shown above may be used, with steps re-ordered, added, or removed. Accordingly, other implementations are within the scope of the following claim(s).

In the description herein, various implementations have been described with reference to numerous specific details that may vary from implementation to implementation. The description and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction. Any definitions expressly set forth herein for terms contained in such claims shall govern the meaning of such terms as used in the claims. In addition, when the term "further comprising" is used in the foregoing description or following claims, what follows this phrase can be an additional step or entity, or a sub-step/sub-entity of a previously-recited step or entity.

Other implementations are in the following claims.

The invention claimed is:

1. A mouth opening device comprising:

a curved body comprising a cross-sectional shape;

a spring disposed around a portion of an outer surface of the curved body, the spring having a cross-sectional shape that is same as or substantially similar to the curved body;

a first arch form comprising:

a first grip with a first opening, the first opening having a shape corresponding to the cross-sectional shape of the curved body, the first grip slidingly disposed between a first end of the spring and a first end of the curved body;

a first bite fork shaped to fit a dental arch of a patient; and a first arm angled with respect to the first grip and the first bite fork and affixing the first grip to the first bite fork;

a second arch form, comprising:

a second grip with a second opening, the second opening having a shape that is substantially similar to the cross-sectional shape of the curved body, the second grip slidingly disposed between a second end of the spring and a second end of the curved body;

a second bite fork shaped to fit the dental arch of the patient; and a second arm angled with respect to the second grip and the second bite fork and affixing the second grip to the second bite fork;

a first end member affixed at a first end of the curved body; and a second end member affixed at a second end of the curved body opposite the first end member.

2. The mouth opening device of claim 1, wherein the cross-sectional shape of the curved body comprises a circular or square cross-sectional shape.

3. The mouth opening device of claim 2, wherein the curved body comprises grooves along at least a portion of a length of the curved body.

4. The mouth opening device of claim 3, wherein the curved body further comprises between two and four grooves.

5. The mouth opening device of claim 1, wherein the spring has a compressive spring constant of 50 Newton/centimeter to 150 Newton/centimeter.

6. The mouth opening device of claim 1, wherein the first bite fork of the first arch form, the second bite fork of the second arch form, or both, are composed of a rigid material.

7. The mouth opening device of claim 1, wherein the first bite fork of the first arch form, the second bite fork of the second arch form, or both, are composed of a malleable material.

8. The mouth opening device of claim 1, wherein the first grip of the first arch form is affixed to the curved body between the first end of the spring and the first end member.

9. The mouth opening device of claim 8, wherein the first end of the spring is further affixed to the first grip of the first arch form.

10. The mouth opening device of claim 1, wherein at least one of the first end member or the second end member are lastingly affixed to the curved body.

11. The mouth opening device of claim 1, wherein the curved body has a radius of curvature of between ten centimeters and fifteen centimeters.

12. The mouth opening device of claim 1, wherein the first opening is located centrally within the first grip.

13. The mouth opening device of claim 1, wherein a diameter of the first opening is smaller than an outer diameter of the spring.

14. The mouth opening device of claim 1, wherein the first opening comprises protrusions extending from an outer circumference of the first opening.

15. The mouth opening device of claim 1, wherein the cross-sectional shape of the curved body is a polygonal shape.

16. A method for using a mouth opening device, the method comprising:

positioning the mouth opening device proximal to a mouth of a patient such that a curved body of the mouth opening device is oriented vertically with respect to the patient;

moving one of a first arch form of the mouth opening device and a second arch form of the mouth opening device toward the other one of the first arch form and the second arch form until bite forks of the first arch form and the second arch form come in physical contact, thereby compressing a spring disposed between the first and second arch form, wherein the first arch form comprises:

a first grip with a first opening, the first opening having a shape corresponding to a cross-sectional shape of the curved body, the first grip slidingly disposed between a first end of the spring and a first end of the curved body;

a first bite fork shaped to fit a dental arch of the patient; and a first arm angled with respect to the first grip and the first bite fork and affixing the first grip to the first bite fork;

disposing biting surfaces that are in the physical contact into the mouth of the patient by advancing the curved body in a proximal direction toward the mouth of the patient;

allowing an extension motion of the spring to contact the bite forks of the first arch form and the second arch form with teeth of the patient; and compressing the spring via mastication motions of a jaw of the patient.

17. The method of claim 16, wherein the curved body comprises a cross-sectional shape.

18. The method of claim 17, wherein the spring is disposed around a portion of an outer surface of the curved body, wherein the spring has a cross-sectional shape substantially similar to the curved body.

19. The method of claim 16, wherein the second arch form comprises:

a second grip with a second opening, the second opening having a shape that is substantially similar to the cross-sectional shape of the curved body, the second grip slidingly disposed between a second end of the spring and a second end of the curved body;

a second bite fork shaped to fit a dental arch of the patient; and a second arm angled with respect to the second grip and the second bite fork and affixing the second grip to the second bite fork.

20. The method of claim 16, wherein the mouth opening device further comprises:

a first end member affixed at a first end of the curved body; and a second end member affixed at a second end of the curved body opposite the first end member.

* * * * *